US005356137A

United States Patent [19]

Carvalho

[11] Patent Number: 5,356,137

[45] Date of Patent: Oct. 18, 1994

[54] SPORTS RACKET WITH INSTRUCTIONAL EXERCISE DEVICE

[76] Inventor: Alcides Carvalho, 928 Beverly Dr., Rock Hill, S.C. 29730

[21] Appl. No.: 186,437

[22] Filed: Jan. 25, 1994

[51] Int. Cl.[5] ..... A63B 49/00; A63B 69/38

[52] U.S. Cl. ..... 273/73 R; 273/29 A

[58] Field of Search ..... 273/73 R, 73 C, 73 D, 273/29 R, 29 A, 74

[56] References Cited

U.S. PATENT DOCUMENTS 4,063,730 12/1977 Bates ..... 273/29 A
4,076,239 2/1978 Hall ..... 273/73 R X
4,249,728 2/1981 Bratt ..... 273/29 A

FOREIGN PATENT DOCUMENTS 2604970 8/1977 Fed. Rep. of Germany ... 273/29 A
2942533 4/1981 Fed. Rep. of Germany ... 273/29 A

*Primary Examiner*—Theatrice Brown
*Assistant Examiner*—Raleigh W. Chiu
*Attorney, Agent, or Firm*—W. Thad Adams, III

[57] ABSTRACT

A sports racket includes a handle, a head, an open frame for supporting interwoven stringing, and an instructional exercise device attached to the stringing. The instructional exercise device includes a casing and one or more instructional image cards. The casing is located within the head of the racket and is removably attached to the stringing. The casing has a viewing surface spaced-apart from the stringing and a connecting surface positioned adjacent to the stringing. The instructional image cards are carried by the casing, and provide a visual demonstration to the user of the proper racket stroke.

10 Claims, 3 Drawing Sheets

SPORTS RACKET WITH INSTRUCTIONAL EXERCISE DEVICE

TECHNICAL FIELD AND BACKGROUND OF THE INVENTION

This invention relates to a sports racket which incorporates an instructional exercise device. The instructional exercise device is attached to the stringing of the racket, and includes a casing for carrying one or more instructional image cards and a removable weight for increasing the weight of the racket. The invention may be utilized both as a teaching device for instructing the user on how to execute the proper racket stroke, and as a warm-up or exercise device for strengthening the muscles in the arms and shoulders of the user.

One prior art exercise assembly for a tennis racket is disclosed in U.S. Pat. No. 4,249,728. The assembly includes first and second opposing weight elements removably attached to the stringing of the racket. The weight elements are used together with a substantially air-impervious racket cover to increase the weight of the racket. The weighted racket functions solely for exercise purposes, and is intended to help develop the particular muscles required to hold and swing the racket. Since the assembly provides no guidance on how to execute a proper swing, the user may injure or aggravate muscles by repeated improper swings of the racket. Moreover, use of this device without personal instruction may promote bad habits, and ultimately, worsen the user's tennis game.

The present invention overcomes this problem of the prior art by providing a sports racket which combines both instruction and an exercise device in a single attachment. The user can readily view the instructional exercise device for guidance on how to properly execute a particular stroke, and then immediately practice the stroke with the weighted racket to strengthen the necessary muscles and to reinforce the proper swing. In addition, the present invention reduces the risk of injury due to improper swings of a weighted racket.

SUMMARY OF THE INVENTION

Therefore, it is an object of the invention to provide a sports racket which may be used for warm-up and exercise purposes, and as a teaching or instructional tool.

It is another object of the invention to provide a sports racket including an instructional exercise device which supplies additional weight to the racket for warm-up and exercise.

It is another object of the invention to provide a sports racket including an instructional exercise device which provides a visual demonstration to the user of a proper stroke form.

It is another object of the invention to provide a sports racket including an instructional exercise device which may be easily attached to and removed from the stringing of the sports racket.

It is another object of the invention to provide a sports racket including an instructional exercise device wherein the instructional exercise device includes a transparent casing.

It is another object of the invention to provide a sports racket including an instructional exercise device wherein the casing carries one or more instructional image cards for being viewed by the user.

It is another object of the invention to provide a sports racket including an instructional exercise device wherein the instructional image cards are hologram cards.

It is another object of the invention to provide a sports racket including an instructional exercise device wherein the casing itself supplies added weight to the racket which helps strengthen the muscles in arms and shoulders of the user during warm-up and exercise.

It is another object of the invention to provide a sports racket including an instructional exercise device which has a removable weight attached thereto for strengthening the muscles in arms and shoulders of the user during warm-up and exercise.

It is another object of the invention to provide a sports racket including an instructional exercise device wherein the instructional exercise device includes an LCD screen and an electronic programmable chip.

These and other objects of the present invention are achieved in the preferred embodiments disclosed below by providing a sports racket having a handle, a head, and an open frame for supporting interwoven stringing. The racket further includes an instructional exercise device including a casing, visual image means, and attachment means. The casing is located within the head of the racket and is removably attached to the stringing. The casing has a viewing surface spaced-apart from the stringing and a connecting surface positioned adjacent to the stringing. The visual image means is carried by the casing for being viewed by the user. The visual image means provides an instructional image demonstrating to the user the proper form of a particular racket stroke. The attachment means removably attaches the casing to the stringing of the sports racket.

According to one preferred embodiment of the invention, the attachment means is a threaded bolt and removable weight. The bolt is attached to and extends from the connecting surface of the casing and passes between the stringing of the racket. The weight has an internally threaded opening formed therein for receiving a free end of the bolt on an opposite side of the stringing. The bolt and the weight cooperate to securely hold the casing to the stringing of the sports racket.

According to another preferred embodiment of the invention, the removable weight weighs between 4 and 12 ounces.

According to yet another preferred embodiment of the invention, the casing includes a substantially transparent top wall, a bottom wall, and a space defined therebetween for receiving and holding the visual image means.

According to yet another preferred embodiment of the invention, the visual image means includes at least one instructional card for being viewed by the user. The instructional card is positioned within the space defined by the top wall and the bottom wall of the casing.

According to one preferred embodiment of the invention, the instructional card is a hologram card.

According to another preferred embodiment of the invention, the instructional card is a superimposed photograph.

According to one preferred embodiment of the invention, the top wall and the bottom wall are connected together at one side edge of the casing by a hinge. The hinge permits outward movement of the top wall from a closed position to an open position. In the open position, the user can access the space defined by the top wall and the bottom wall to insert the visual image means therein.

According to another preferred embodiment of the invention, the top wall is held in the closed position by a lap joint formed on one side edge of the casing opposite the hinge.

According to yet another preferred embodiment of the invention, an anti-rotation peg is attached to the connecting surface of the casing and extends slightly beyond the stringing of the racket to prevent rotational movement of the casing.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
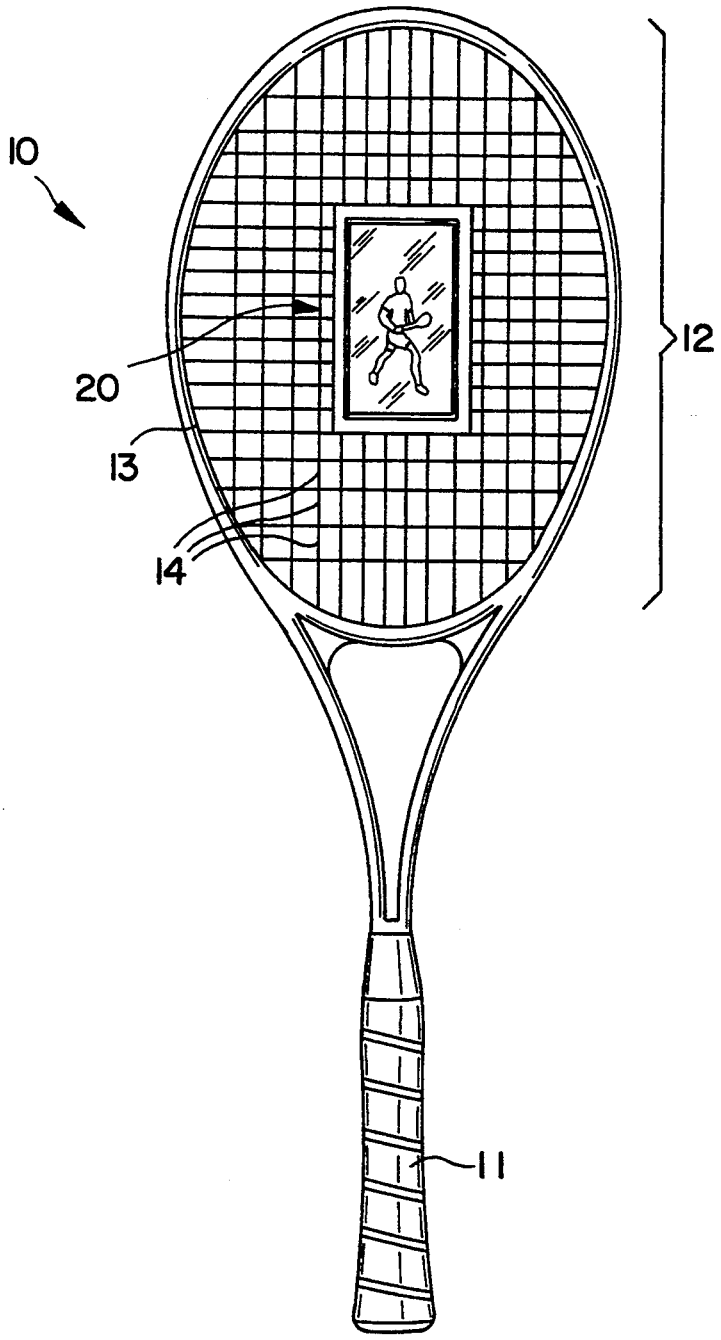
FIG. 1 is a front elevation of a sports racket and instructional exercise device according to a preferred embodiment of the present invention.

Referring now specifically to the drawings, a sport racket according to the present invention is illustrated in FIG. 1 and shown generally at reference numeral 10. The sports racket 10 shown in FIG. 1 is a tennis racket including a handle 11, a head 12 with an open frame 13 for supporting interwoven stringing 14. An instructional exercise device 20 is attached to the stringing 14 of the racket 10 for demonstrating to the user how to perform a proper racket stroke for a particular racket sport. Although a tennis racket is shown and described below, the instructional exercise device 20 may be combined with any similar racket for use in sports, such as a squash, racquetball, badminton, and the like.

Figure 2:
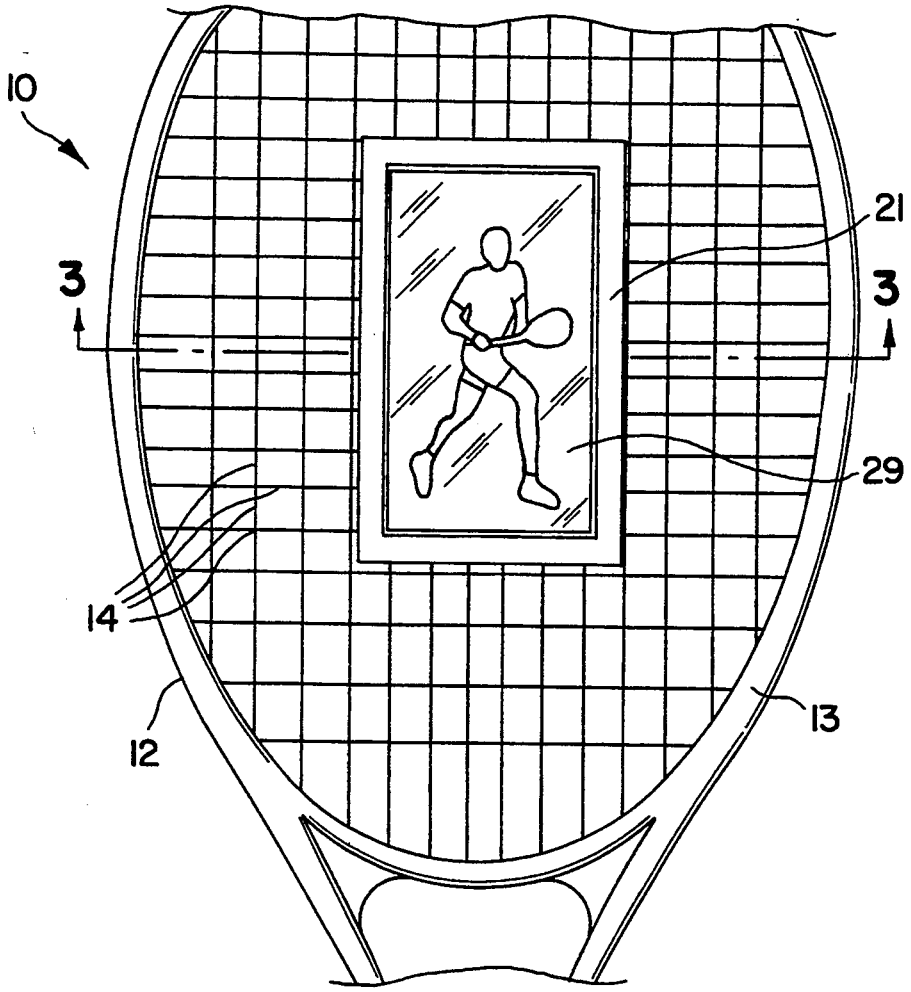
FIG. 2 is a fragmentary view of the head portion of the sports racket shown in FIG. 1, illustrating the casing of the instructional exercise device including an instructional image card contained therein.
Figure 3:
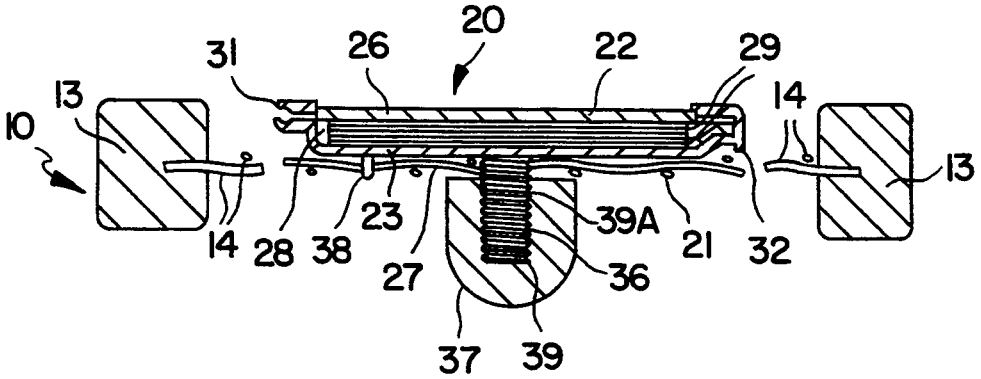
FIG. 3 is a slightly enlarged and fragmentary cross-sectional view of the sports racket and instructional exercise device taken substantially along lines 3—3 of FIG. 2.

Referring to FIGS. 2 and 3, the instructional exercise device 20 includes a casing 21 attached to the stringing 14 of the racket 10, and having a viewing surface 22 and a connecting surface 23. The casing 21 includes a transparent top wall 26, a bottom wall 27, and a space 28 defined therebetween for housing one or more instructional image cards 29. The casing 21 is preferably constructed of a clear or tinted polypropylene material. According to one embodiment, the casing 21 is rectangular, and is approximately 3.25 inches (8.25 cm) wide and 4.75 inches (12.0 cm) long. Alternatively, the casing 21 may have a circular or triangular shape, not shown.

Figure 4:
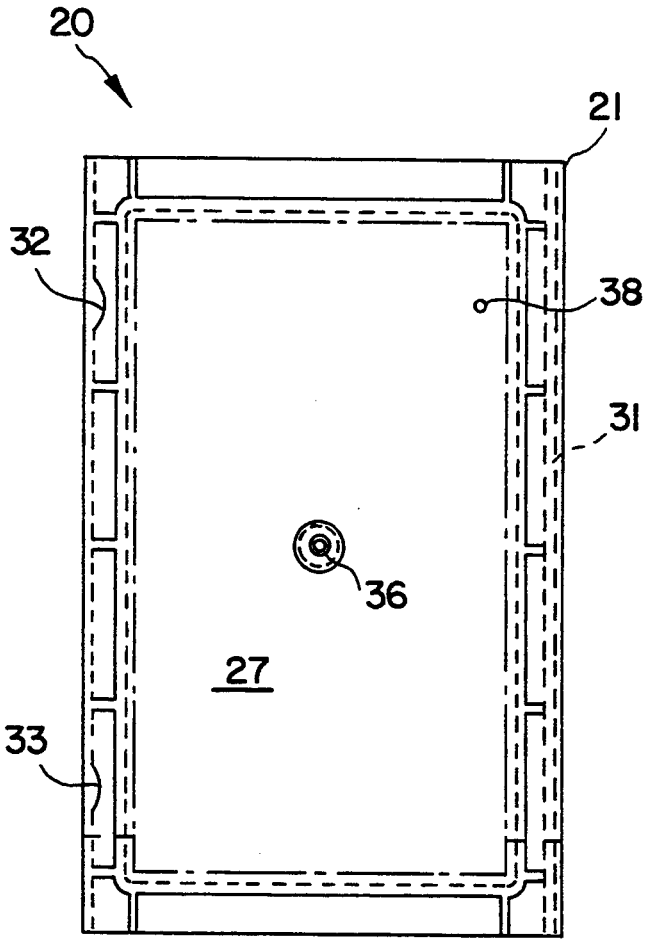
FIG. 4 is a view of the back side of the casing showing particularly the lap joints for holding the top wall of the casing in the closed position.

Preferably, the top wall 26 and bottom wall 27 of the casing 21 are connected together at one side edge of the casing 21 by a continuous-length acrylic hinge 31. The hinge 31 may be of the type manufactured by Westedge Incorporated, and sold under the trademark "Flex-Fold." The hinge 31 permits outward movement of the top wall 26 of the casing 21 from a closed position shown in FIG. 3 to an open position (not shown). When in the open position, the user can readily insert and remove the instructional image cards 29 from the space 28 defined by the casing 21. As best shown in FIGS. 3 and 4, the top wall 26 of the casing 21 is releasably held in the closed position by lap joints 32 and 33 formed on one side of the casing 21 opposite the hinge 31. The lap joints 32 and 33 provide a convenient "snap-attachment," while securely holding the top wall 26 of the casing 21 in the closed position during use of the sports racket 10.

Figure 5:
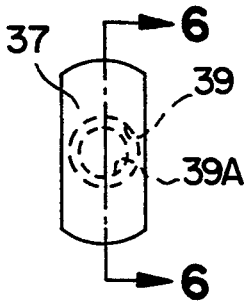
FIG. 5 is a top plan view of the removable weight for being mated with the threaded bolt of the casing.
Figure 6:
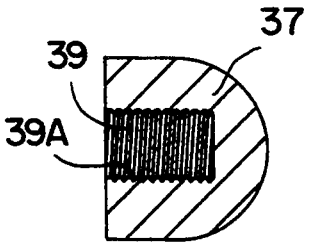
FIG. 6 is a cross-sectional view of the weight shown in FIG. 5 taken substantially along lines 6—6.

As shown in FIG. 3, the casing 21 has a threaded bolt 36 attached to the connecting surface 23 thereof, and extending through the stringing 14 of the sports racket 10. Preferably, a removable metal weight 37 having an opening 39 with an internal screw thread 39A formed therein is mated with the bolt 36 to securely attach the casing 21 to the stringing 14. The weight 37 is shown separately in FIGS. 5 and 6. The weight 37 further serves to provide added weight to the sports racket 10, and is preferably molded in 4, 8, and 12 ounce sizes. The added weight helps to strengthen the muscles in the forearms and shoulders of the user as he or she practices the proper stroke form demonstrated by the instructional image cards 29.

Alternatively, the instructional exercise device 20 does not include the bolt 36 and removable weight 37. Instead, the casing 21 may be attached to the stringing 14 by other suitable means.

According to one preferred embodiment, the instructional image cards 29 are hologram cards produced by a holographic interferometry process which produces a three-dimensional image in space of a tennis player executing the proper stroke form for swings such as the forehand, backhand, and serve. By maneuvering the sports racket 10 slightly from side to side, the tennis player shown in the card 29 fully executes the proper swing of the racket 10. The instructional image cards 29 may be one, two, or three channel holograms, or other similar holograms produced by companies such as Light Impressions, Inc. of Santa Cruz, Calif. or White Light Works, Inc. of Woodland Hills, Calif. Alternatively, the instructional image card 29 may be a superimposed photograph of a tennis player with a racket 10, the photograph illustrating the location of the racket 10 at successive stages of the particular swing. In a third embodiment, the instructional image card 29 may be a line drawing of a tennis player with a racket 10, and an arrow showing the proper movement of the racket 10 throughout the particular stroke.

As shown in FIGS. 3 and 4, an anti-rotation peg 38 is preferably attached to the connecting surface 23 of the casing 21. The anti-rotation peg 38 extends just beyond the stringing 14 on an opposite face thereof to prevent rotation of the instructional exercise device 10 as the user practices his or her swing.

In an alternative embodiment (not shown), the instructional exercise device may include an LCD screen and a small electronic chip. As commanded by the user, the device would display a visual image on the LCD screen of a tennis player executing the programmed stroke.

A sports racket including a removable, instructional exercise device is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A sports racket having a handle, a head, and an open frame for supporting interwoven stringing, and including an instructional exercise device, said instructional exercise device comprising:

(a) a casing located within the head of the racket and removably attached to the stringing, said casing having a viewing surface spaced-apart from the stringing and a connecting surface positioned adjacent to the stringing;

(b) visual image means carried by said casing for being viewed by the user, said visual image means providing an instructional image for demonstrating to the user the proper form of a particular racket stroke; and (c) attachment means for removably attaching said casing to the stringing of said sports racket.

2. A sports racket according to claim 1, wherein said attachment means comprises a threaded bolt attached to and extending from the connecting surface of said casing and passing between the stringing of said racket, and a removable weight having an internally threaded opening formed therein for receiving a free end of said bolt on an opposite side of said stringing.

3. A sports racket according to claim 2, wherein said removable weight weighs between 4 and 12 ounces.

4. A sports racket according to claim 1, wherein said casing includes a substantially transparent top wall, a bottom wall, and a space defined therebetween for receiving and holding said visual image means.

5. A sports racket according to claim 4, wherein said visual image means comprises at least one instructional card for being viewed by the user, said instructional card positioned within said space defined by the top wall and the bottom wall of said casing.

6. A sports racket according to claim 5, wherein said at least one instructional card comprises a hologram card.

7. A sports racket according to claim 5, wherein said at least one instructional card comprises a superimposed photograph.

8. A sports racket according to claim 4, wherein said top wall and said bottom wall are connected together at one side edge of said casing by a hinge for permitting outward movement of said top wall from a closed position to an open position, whereby in the open position the user can access the space defined by the top wall and the bottom wall to insert said visual image means therein.

9. A sports racket according to claim 8, wherein said top wall is held in the closed position by a lap joint formed on one side edge of said casing opposite said hinge.

10. A sports racket according to claim 1, further comprising an anti-rotation peg attached to the connecting surface of said casing and extending slightly beyond the stringing of said racket to prevent rotational movement of said casing.

* * * * *